US007997509B2

(12) United States Patent
Karklins et al.

(10) Patent No.: US 7,997,509 B2
(45) Date of Patent: Aug. 16, 2011

(54) PORTION-CONTROLLED DISPENSING STRAW ASSEMBLY

(75) Inventors: Dana Karklins, Lake Worth, FL (US); Joseph P. Baratta, Boca Raton, FL (US)

(73) Assignees: Dana Karklins, Boca Raton, FL (US); Joseph P. Baratta, Boca Raton, FL (US)

( * ) Notice: Subject to any disclaimer, the term of this patent is extended or adjusted under 35 U.S.C. 154(b) by 551 days.

(21) Appl. No.: 12/173,555

(22) Filed: Jul. 15, 2008

(65) Prior Publication Data

US 2009/0250358 A1 Oct. 8, 2009

Related U.S. Application Data

(60) Provisional application No. 61/043,270, filed on Apr. 8, 2008.

(51) Int. Cl.
*A47G 21/18* (2006.01)

(52) U.S. Cl. ..... 239/33; 426/85; 206/219; 206/222

(58) Field of Classification Search ..... 206/219, 206/222; 222/80, 81, 89; 426/85, 112; 604/87, 604/88; 215/DIG. 8, 388; 239/33
See application file for complete search history.

(56) References Cited

U.S. PATENT DOCUMENTS

| | | | | |
|---|---|---|---|---|
| 2,815,981 | A | 12/1957 | Nonnamaker et al. | |
| 2,867,536 | A | 1/1959 | Mead et al. | |
| 3,344,914 | A * | 10/1967 | Bloom et al. | 206/222 |
| 3,521,745 | A | 7/1970 | Schwartzman | |
| 3,610,483 | A * | 10/1971 | Visconti et al. | 222/478 |
| 3,638,918 | A * | 2/1972 | Denholtz | 206/222 |
| 3,870,147 | A * | 3/1975 | Orth | 206/222 |
| 4,294,351 | A | 10/1981 | Cheetham | |
| 4,387,998 | A | 6/1983 | Szigeti | |
| 4,903,865 | A * | 2/1990 | Janowitz | 222/83.5 |
| 4,981,468 | A | 1/1991 | Benefiel et al. | |

(Continued)

FOREIGN PATENT DOCUMENTS

FR 2664570 A1 1/1992

(Continued)

OTHER PUBLICATIONS

International Search Report and written opinion dated Nov. 24, 2009.

*Primary Examiner* — David Fidei
(74) *Attorney, Agent, or Firm* — Laurence A. Greenberg; Werner H. Stemer; Ralph E. Locher

(57) ABSTRACT

A portion-controlled dispensing straw assembly includes inner and outer telescoping tubes. The outer tube has an upper edge and a lower edge, and the inner tube has an upper edge, a lower edge and an interior chamber for receiving a substance to be dispensed. A seal is disposed within and attached to the outer tube, below the inner tube, for preventing the substance from exiting the interior chamber in a substance-retaining condition. A cap has a lower edge resting on the upper edge of the inner tube in the substance-retaining condition. The cap, upon being depressed, pushes the inner tube within the outer tube to break the seal and allow the substance received in the interior chamber to fall out of the tubes in a substance-releasing condition. The cap, upon being removed, also opens a passage allowing the tubes to be used as a straw.

12 Claims, 3 Drawing Sheets

U.S. PATENT DOCUMENTS

| | | | | |
|---|---|---|---|---|
| 5,782,345 | A | 7/1998 | Guasch et al. | |
| 6,098,795 | A * | 8/2000 | Mollstam et al. | 206/222 |
| 7,025,200 | B2 | 4/2006 | Fontana | |
| 7,347,322 | B2 * | 3/2008 | Cho | 206/222 |
| 7,562,771 | B2 * | 7/2009 | Fontana | 206/222 |
| 2003/0213709 | A1 * | 11/2003 | Gibler et al. | 206/219 |
| 2005/0205438 | A1 * | 9/2005 | Hierzer et al. | 206/222 |
| 2005/0218242 | A1 * | 10/2005 | Renz et al. | 239/24 |

FOREIGN PATENT DOCUMENTS

| | | | |
|---|---|---|---|
| JP | 7024491 | U | 5/1995 |
| WO | 92/00898 | A1 | 1/1992 |
| WO | WO 2006/111803 | * | 10/2006 |

* cited by examiner

PORTION-CONTROLLED DISPENSING STRAW ASSEMBLY

CROSS-REFERENCE TO RELATED APPLICATION

This application claims the priority, under 35 USC §119 (e), of U.S. Provisional Patent Application No. 61/043,270, filed Apr. 8, 2008.

BACKGROUND OF THE INVENTION

1. Field of the Invention

The invention relates to a portion-controlled dispensing straw assembly used to dispense substances in exact amounts into a container or directly into the mouth of a user.

2. Description of the Related Art

Prior art dispensing devices are wasteful, unsanitary, inexact and limited in the portions they can control. For example, sweeteners can be dispensed from packets, but if the use of more sweetener than the packet holds is desired, additional packets must be used, creating additional waste and requiring additional time. Liquid medicines are poured from a bottle into a measuring spoon, but the amount is never exact. Alcoholic beverages and mixers are poured into a glass in inexact fashion and then a straw or the like is needed to mix the drink. The same is true for creamers. Most of those uses require the use of the hands in proximity to the fluid, which makes them unsanitary as well.

U.S. Pat. No. 7,025,200 B2 discloses two coaxial containers holding different products. Downward pressure on a portion 14 causes a profile 11 to pierce a diaphragm 6, as is seen by a comparison of FIGS. 1 and 2.

U.S. Pat. No. 5,782,345 similarly discloses two containers. When a cap 23 is screwed onto a thread 14, an edge 17 presses on and tears a bottom 28 while a point 18 keeps the bottom 28 from tearing loose.

U.S. Pat. No. 3,521,745 discloses a mixing package 10 having a container 12 and an adapter 14, both holding products. When a cap 18 is pushed down, membranes 20, 22 are broken to mix the contents of the two containers.

International Publication No. PCT WO92/00898 discloses two telescoping tubes 1, 5 which are pushed together so that a beveled edge 7 of a tube 5 pierces a closing disk 4 of a tube 1. As is seen in FIG. 2, this causes the closing disk 4 to be pushed 4 off to the side.

U.S. Pat. No. 2,815,981 discloses a straw in which a mouthpiece 16 is pinched and held and an inner tube 12 is reciprocated in an outer member 10 to mix sugar in iced tea. The device is used for mixing only, not for dispensing.

U.S. Pat. No. 4,981,468 discloses a sleeve 26 telescoping in a tube 12. A grid 18 in the sleeve 26 holds a therapeutic agent 20 so that liquid sipped through the device passes through the agent 20 in the sleeve. The agent remains in place and is mixed within the straw, not in any container or glass outside the straw.

U.S. Pat. No. 2,867,536 discloses a straw having a bore tube 2 in an outer tube 1. The tubes are sealed together by limbs 4 in FIG. 1 or by pinching at 5 in FIG. 2. A plug 6 and a cap 3 in FIG. 1 or two caps 3 in FIG. 2 are removed to use the straw and let a flavoring agent in the form of solids or powder 9 mix in a glass. No mixing can take place until a plug and a cap or caps at both ends of the straw, are removed.

Thus, the prior art falls into two categories. In one category, devices are provided which mix two substances together, but cannot be used as straws. Although coaxial tubes piercing a seal are known, they are not and cannot then be used as straws.

U.S. Pat. Nos. 7,025,200 B2, 5,782,345 and 3,521,745, as well as International Publication No. PCT WO92/00898, fall into that category.

The other category contains devices which are used as straws. In that category, U.S. Pat. No. 2,815,981 is merely used for stirring and does not contain any substance to be mixed. U.S. Pat. No. 4,981,468 maintains the substance within the straw and therefore only allows it to be mixed to a limited extent and only with what ever amount of liquid is consumed. U.S. Pat. No. 2,867,536 requires a plug or cap to be removed from both ends. The cap at the bottom must be removed before placing the lower end of the straw in the liquid with which the substance is to be mixed. The bottom cap may be removed when the bottom is directed upward or downward. Such a system is difficult to use because the substance can spill in any direction when removing the bottom cap with the bottom directed downward. Similarly, the substance can spill in any direction when placing the open bottom in a container after the cap is removed with the bottom directed upward. The device is also potentially unsanitary because a user may touch a portion of the straw to be immersed when removing the cap.

BRIEF SUMMARY OF THE INVENTION

It is accordingly an object of the invention to provide a portion-controlled dispensing straw assembly, which overcomes the hereinafore-mentioned disadvantages of the heretofore-known devices of this general type, in which the bottom of the straw need not be touched by the user for activation, in which all of the substance contained in the straw can be easily released into a container where mixing occurs from a location which will not be immersed in liquid and therefore maintains sanitary conditions, which is exact, easy to use, creates little waste and does not require a separate straw.

With the foregoing and other objects in view there is provided, in accordance with the invention, a portion-controlled dispensing straw assembly, comprising inner and outer telescoping tubes. The outer tube has an upper edge and a lower edge, and the inner tube has an upper edge, a lower edge and an interior chamber for receiving a substance to be dispensed. A seal is disposed within and attached to the outer tube, below the inner tube, for preventing the substance from exiting the interior chamber in a substance-retaining condition. A cap has a lower edge resting on the upper edge of the inner tube in the substance-retaining condition. The cap, upon being depressed, pushes the inner tube within the outer tube to break the seal and allow the substance received in the interior chamber to fall out of the tubes in a substance-releasing condition. The cap, upon being removed, opens a passage allowing the tubes to be used as a straw.

The assembly of the invention is thus actuated from a portion of the straw to be located above a liquid in a container and therefore the bottom need not be touched. This is done with an inner tube piercing a seal as it is moved within an outer tube to let the contents fall out of the inner tube and then using the tubes as a straw.

In accordance with another feature of the invention, a release of the substance received in the interior chamber to fall out of the tubes is actuated solely by depressing the cap. Unlike the prior art, there is no need to handle any part of the assembly to release the substance, except the cap.

In accordance with a further feature of the invention, the upper edge of the outer tube extends beyond the upper edge of the inner tube in the substance-retaining condition. This allows the extension of the cap to be supported by the outer tube.

In accordance with an added feature of the invention, a knife edge is disposed on the lower edge of the inner tube for breaking the seal. Although the seal may be broken by the lower edge alone, the knife edge is more efficient. The knife edge preferably is annular and has a gap formed therein causing a living hinge of the seal to remain attached to the outer tube upon breaking the seal. This prevents the seal from falling down into the container with the substance being released.

In accordance with an additional feature of the invention, the seal is disposed between the tubes in the substance-releasing condition. This even further ensures that the seal will not become loose.

In accordance with yet another feature of the invention, an outlet attachment is to be attached to the lower edge of the inner tube for dispensing the substance into the mouth. This feature is especially useful when dispensing medication, for example into the mouth of a child or an animal.

In accordance with yet a further feature of the invention, a snap fitting is provided between the cap and the outer tube. The snap fitting, which includes a bead and a notch or groove, maintains the substance securely within the interior chamber and prevents contamination from outside. However, a plastic wrap may be used alternatively or in addition.

In accordance with yet an added feature of the invention, the lower edge of the outer tube has a bevel formed thereon. The bevel prevents the bottom of the outer tube form being suctioned to the container when sipping through the straw and becoming thus blocked.

In accordance with yet an additional feature of the invention, the cap includes an extension having the lower edge of the cap, and the cap includes a lid overhanging the extension to facilitate removal of the cap by the thumb. This feature allows easy removal of the cap by a flick of the thumb.

In accordance with again another feature of the invention, a tab interconnects the outer tube and the cap. In this way, it is ensured that the cap will not become lost or contaminated, in case it needs to be put back in place on the tubes.

In accordance with a concomitant feature of the invention, an additional seal is disposed at a location below the first-mentioned seal preventing the substance from exiting the interior chamber. The additional seal maintains cleanliness and prevents contamination within the tubes. The additional seal is also broken by depressing the cap without requiring any further actuation.

Therefore, according to the invention, one simple action of depressing the cap with one hand from a location which will not be immersed in liquid and therefore maintains sanitary conditions, breaks the seal, prevents the seal from falling off, breaks any optional additional seal, causes the substance which is pre-measured in an exact amount to fall into a container or be dispensed into the mouth and provides a straw to mix the substance with any additional substance that may be present in a container and to drink through.

Other features which are considered as characteristic for the invention are set forth in the appended claims.

Although the invention is illustrated and described herein as embodied in a portion-controlled dispensing straw assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
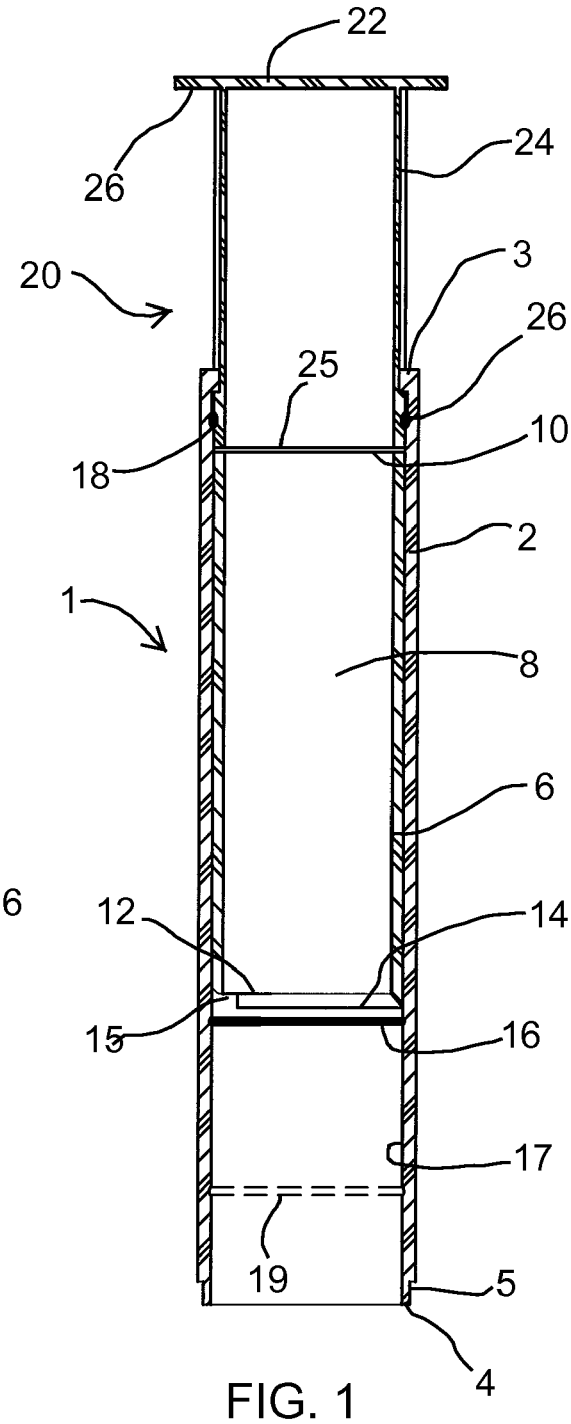
FIG. 1 is a diagrammatic, longitudinal-sectional view of a portion-controlled dispensing straw assembly according to the invention in a substance-retaining condition.

Referring now to the figures of the drawings in detail and first, particularly, to FIG. 1 thereof, there is seen a portion-controlled dispensing straw assembly having a straw 1 with an outer tube 2 and an inner tube 6 which telescopes therein. Both tubes 2, 6 are preferably but not necessarily cylindrical, and are formed of flexible material, such as plastic or paper which is easily deformed.

The outer tube 2 has an upper edge 3 and a lower edge 4 with an outer step 5. The inner tube 6 defines an interior chamber 8 for receiving a substance to be dispensed and mixed. The inner tube 6 also has an upper edge 10 and a lower edge 12 with an annular knife edge 14 disposed thereon. The lower edge 12 may also simply be pointed instead of having the knife edge. It may be seen that the knife edge 14 extends around most of the lower edge 12, but has a gap 15 at a portion of the lower edge 12 toward the left in FIG. 1. A seal 16, which may be formed of plastic or metal foil, is adhesively connected to an inner side wall 17 of the outer tube 2, near the lower edge 12 of the inner tube 6, so as to maintain the substance in the interior chamber 8. The seal 16 is circular in order to match the inner cross section of the outer tube 2. An optional additional seal may be disposed at a location 19 along the inner side wall 17 of the outer tube 2 to maintain cleanliness and prevent contamination within the straw 1. It is understood that the location 19 may be directly at the lower edge 4, but has been shown somewhat apart from the lower edge 4 for clarity of illustration.

A cap 20 of the dispensing straw assembly has a horizontal lid 22 at the top and an extension 24 with a lower edge 25 resting on the upper edge 10 of the inner tube 6 in the substance-retaining condition shown in FIG. 1. The cap 20 also has an annular bead 26, which is engaged in an annular notch or groove 18 formed in the inner side wall 17 of the outer tube 2. Alternatively or additionally, the extension 24 of the cap and the upper portion of the outer tube 2 may be covered with a plastic wrap. These measures and others are taken to keep the substance or contents in the interior chamber 8 free of contamination. The lower edge 25 of the extension 24 may be closed so as to define an upper limit of the interior chamber 8 or it may be open to enlarge the interior chamber 8.

Figure 2:
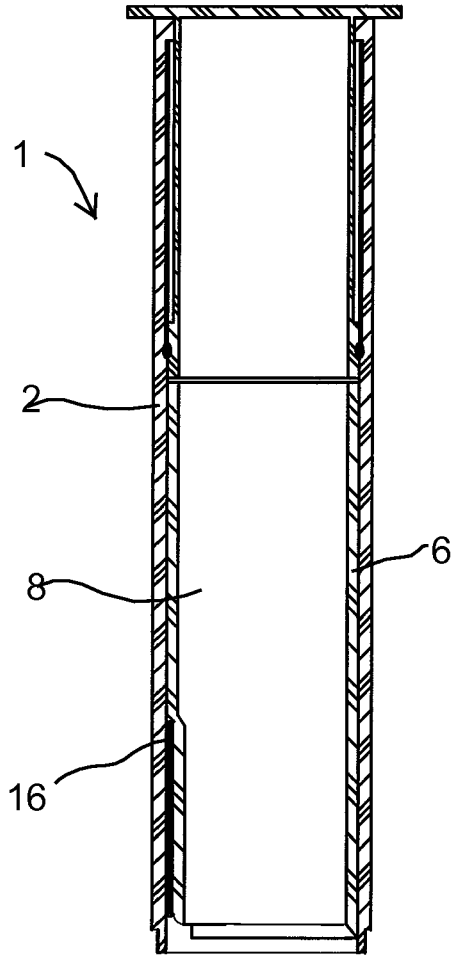
FIG. 2 is a longitudinal-sectional view of the dispensing straw assembly in a substance-releasing condition.

In order to operate the dispensing straw assembly, the cap 20 is depressed manually to release the snap lock between the bead 26 and the groove 18, such as by pushing down on the lid 22 with the thumb, while grasping the outer tube 2 with the fingers until the two tubes are coextensive. The depression of the cap takes place from a location which will not be immersed in liquid and therefore maintains sanitary conditions. As the cap 20 is depressed, it pushes the inner tube 6 down so as to telescope from the substance-retaining condition shown in FIG. 1 into a substance-releasing condition shown in FIG. 2. The knife edge 14 or pointed lower edge 12 will break the seal 16. However, the seal 16 will remain attached to the inner side wall 17 of the outer tube 2 by a living hinge of the seal 16 at the gap 15. Due to the flexibility of the tubes, the downwardly hinged seal 16 will become engaged or squeezed between the tubes 2, 6 as shown in FIG. 2. The inner tube 6 has been shown to be deformed to receive the seal 16, but in actuality, the outer tube 2 may deform or they may both deform. One tube may also be made stiffer or thicker than the other to ensure that a particular desired tube will deform.

Figure 3:
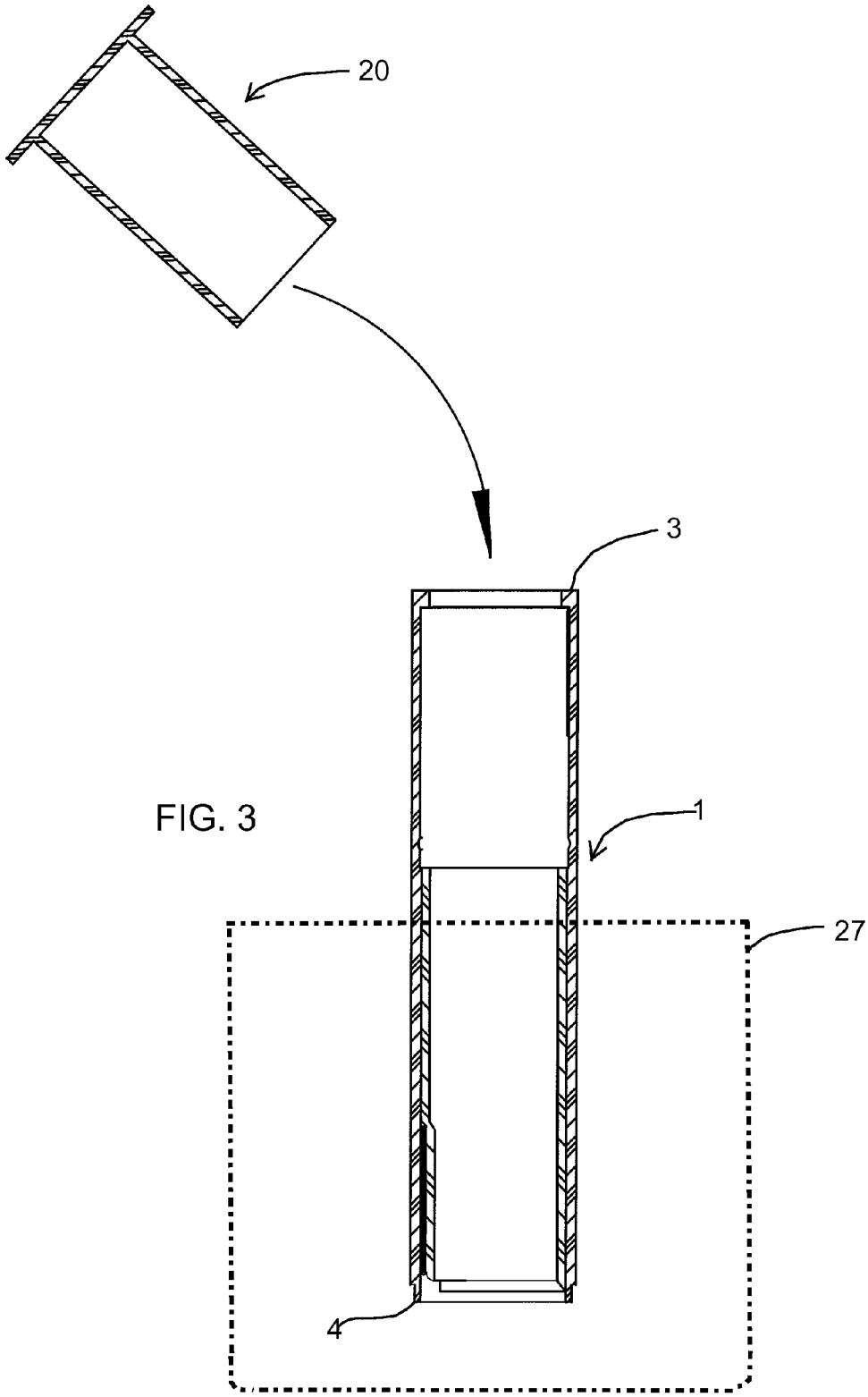
FIG. 3 is a longitudinal-sectional view of the dispensing straw assembly shown in FIG. 3, with a cap removed and being partly immersed in a container.

After the seal is broken, the substance within the interior chamber 8 will drop down out of the straw 1 and into a container 27 shown in FIG. 3, such as a cup or glass, or to any desired location, such as the mouth of the user if the substance is medication, for example. The cap 20 is then removed by flicking the lid 22 with the thumb nail under an overhang 26 of the lid 22 extending beyond the extension 24. This will disengage the bead 26 from the notch 18. The cap 20, upon being removed, opens a passage allowing the tubes 2, 6 to be used as a straw. If the substance is liquid, it will also ensure that all of the liquid pours out of the interior chamber 8 into the container 27. The container 27 may or may not hold any other substance to be mixed with the substance from the interior chamber 8.

In this condition, with the seal 16 broken and the lid 22 removed as seen in FIG. 3, the straw 1 is completely open, provides a passage from the upper edge 3 to the lower edge 4 and can be used to drink the substance which was contained in the interior chamber 8 or any mixture of that substance with another substance poured into the container 27. The arrow in FIG. 3 indicates that the cap 20 may also be replaced to maintain cleanliness and prevent contamination of the upper portion of the outer tube 2 if it is anticipated that the straw will not be used for a period of time. The top of the straw 1, which touches the mouth of the user, is never touched by the hand of the user, so that it remains uncontaminated.

Figure 4:
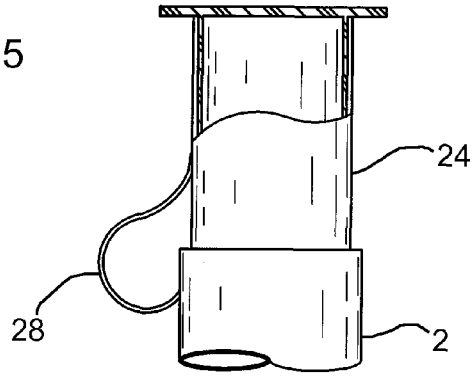
FIG. 4 is a fragmentary, partly broken-away elevational view of an alternative embodiment of the cap of the dispensing straw assembly.

FIG. 4 shows an alternative embodiment of the portion-controlled dispensing straw assembly, in which the outer tube 2 and the extension 24 of the cap 20 are interconnected by a tab 28. In this way, the cap may be retained and used to re-close the straw 1.

Figure 6:
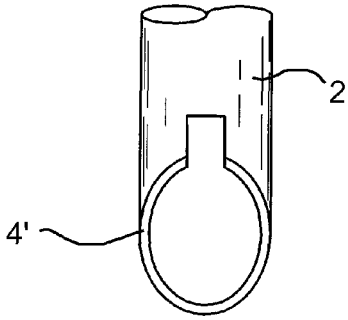
FIGS. 5 and 6 are fragmentary, perspective views of a different embodiment of a lower edge of the dispensing straw assembly.
Figure 5:
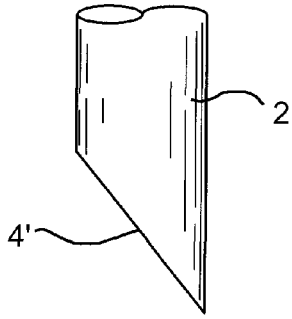

FIGS. 5 and 6 show an alternative embodiment of the lower edge of the outer tube 2. In FIGS. 5 and 6, a lower edge 4' is beveled to prevent the lower edge from adhering to the bottom of the container 27 when the user of the assembly suctions liquid through the straw. Even if the lower edge 4' is used at an angle against the side of a container 27, the keyhole shape of the lower edge 4' will prevent blockage.

Figure 7:
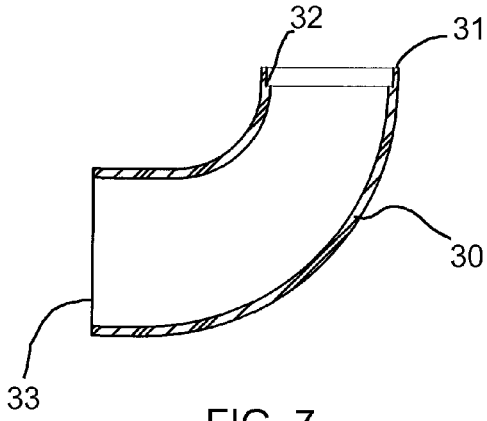
FIG. 7 is a longitudinal-sectional view of an optional elbow-shaped outlet attachment to be snapped to the body of the dispensing straw assembly.

As mentioned above, the straw 1 may be used to dispense medication. Therefore, FIG. 7 shows an optional elbow-shaped outlet attachment 30 having an upper edge 31 with an inner step 32 that may be snapped or clipped onto the outer step 5 of the outer tube 2. A lower edge 33 of the outlet attachment 30 may be placed in the mouth, such as for dispensing medication to a child or animal. Unlike standard dispensing spoons, the medication will not be dispensed until the cap is depressed, ensuring that the outlet attachment 30 is in the mouth and spillage will not occur.

If the assembly 1, 20 is used to hold any fluid to be mixed with another, such as an alcoholic beverage, fruit juice, mixer, sweetener, creamer or medicine to be mixed in a drinking glass, the assembly is used as a straw for mixing and sipping the mixed drink from the glass. Solids such as orange, lemon or lime or any other powder can also be placed in and disposed from the assembly.

The invention claimed is:

1. A portion-controlled dispensing straw assembly, comprising:

a dispensing straw including:

inner and outer telescoping tubes, said outer tube having an upper edge and a lower edge, and said inner tube having an upper edge, a lower edge and an interior chamber for receiving a substance to be dispensed;

a seal disposed within and attached to said outer tube, below said inner tube lower edge, for preventing the substance from exiting said interior chamber in a substance-retaining condition; and a cap having a lower edge resting on said upper edge of said inner tube in said substance-retaining condition;

said cap, upon being depressed, pushing said inner tube within said outer tube to break said seal and allow the substance received in said interior chamber to fall out of said tubes in a substance-releasing condition; and said cap, upon being removed, opening a completely open passage forming said dispensing straw for sipping up the substance at said upper edges of said tubes from at said lower edges of said tubes, whether or not any other substance is present at said lower edges of said tubes.

2. The assembly according to claim 1, wherein a release of the substance received in said interior chamber to fall out of said tubes is actuated solely by depressing said cap.

3. The assembly according to claim 1, wherein said upper edge of said outer tube extends beyond said upper edge of said inner tube in said substance-retaining condition.

4. The assembly according to claim 1, which further comprises a knife edge disposed on said lower edge of said inner tube for breaking said seal.

5. The assembly according to claim 4, wherein said knife edge is annular and has a gap formed therein causing a living hinge of said seal to remain attached to said outer tube upon breaking said seal.

6. The assembly according to claim 1, wherein said seal is disposed between said tubes in said substance-releasing condition.

7. The assembly according to claim 1, which further comprises an outlet attachment to be attached to said lower edge of said inner tube for dispensing the substance into the mouth.

8. The assembly according to claim 1, which further comprises a snap fitting between said cap and said outer tube.

9. The assembly according to claim 1, wherein said lower edge of said outer tube has a bevel formed thereon.

10. The assembly according to claim 1, wherein said cap includes an extension having said lower edge of said cap, and said cap includes a lid overhanging said extension to facilitate removal of said cap by the thumb.

11. The assembly according to claim 1, which further comprises a tab interconnecting said outer tube and said cap.

12. The assembly according to claim 1, which further comprises an additional seal disposed at a location below said seal preventing the substance from exiting said interior chamber, said additional seal maintaining cleanliness and preventing contamination within said tubes.

* * * * *